US005178298A

United States Patent [19]

Allina

[11] Patent Number: 5,178,298

[45] Date of Patent: Jan. 12, 1993

[54] CANDY DISPENSER

[76] Inventor: Curtis J. Allina, 14997 Starr Rd., SE., Olalla, Wash. 98359

[21] Appl. No.: 835,709

[22] Filed: Feb. 12, 1992

[51] Int. Cl.[5] ..... G07F 11/20

[52] U.S. Cl. ..... 221/24; 221/197; 221/199; 221/229; 221/269; 221/270; 221/279; 206/457; 206/535

[58] Field of Search ..... 221/24, 197, 198, 228, 221/229, 255, 256, 263, 268, 269, 270, 279, 280; 206/535, 536, 445, 457

[56] References Cited

U.S. PATENT DOCUMENTS

| | | | |
|---|---|---|---|
| 2,620,061 | 12/1952 | Uxa | 206/42 |
| 2,853,206 | 9/1958 | Uxa | 221/229 |
| 3,410,455 | 11/1968 | Haas | 221/229 |
| 3,422,991 | 1/1969 | MacDougall et al. | 221/256 X |
| 3,565,284 | 2/1971 | Hinterreiter | 221/229 |
| 3,844,445 | 10/1974 | Haas | 221/229 |
| 3,845,882 | 11/1974 | Haas | 221/279 |
| 3,942,683 | 3/1976 | Haas | 221/229 |
| 4,000,831 | 1/1977 | House | 221/229 X |
| 4,171,753 | 10/1979 | Vreede | 221/197 |
| 4,295,580 | 10/1981 | Amberg | 221/268 |
| 4,311,251 | 1/1982 | Sternberg | 221/24 |
| 4,589,575 | 5/1986 | Rigberg et al. | 221/228 X |
| 5,099,232 | 3/1992 | Howes | 206/457 X |

FOREIGN PATENT DOCUMENTS

| | | |
|---|---|---|
| 3143953 | 5/1983 | Fed. Rep. of Germany . |
| 794374 | 2/1936 | France . |
| 1224690 | 6/1960 | France . |

*Primary Examiner*—Robert P. Olszewski
*Assistant Examiner*—Dean A. Reichard
*Attorney, Agent, or Firm*—Bruce A. Kaser

[57] ABSTRACT

The disclosed invention is a candy tablet dispenser shaped to simulate a beverage can, or the like. What would normally be the pop-top region of the can slides laterally outwardly and, at the same time, ejects a tablet from the top of a stack of tablets that is stored internally. The ejector portion is finger-driven back and forth.

8 Claims, 3 Drawing Sheets

Fig. 2
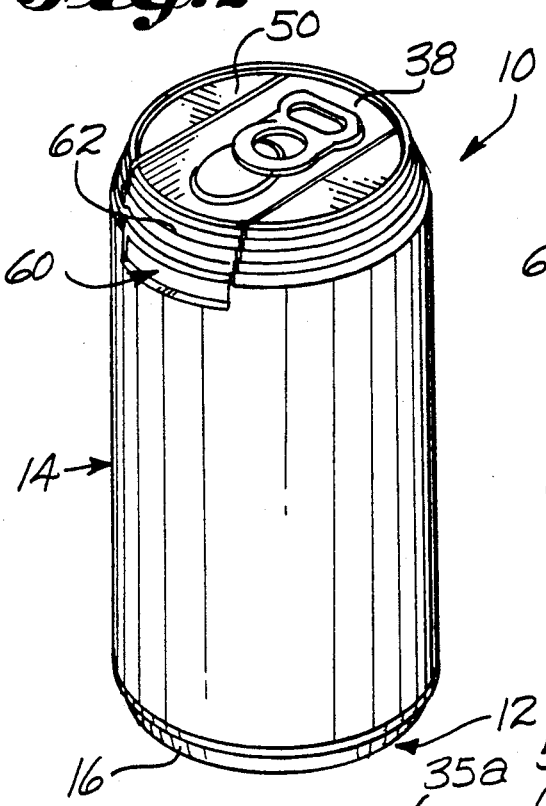
Fig. 3
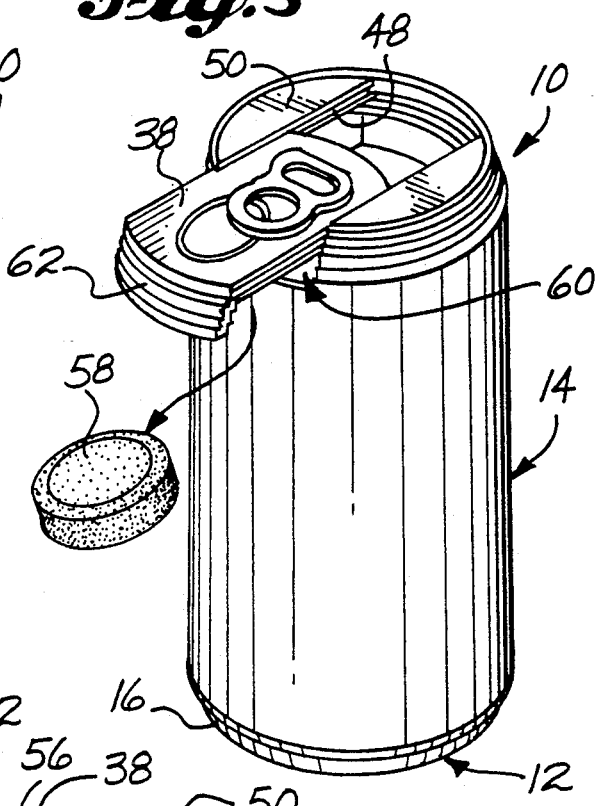
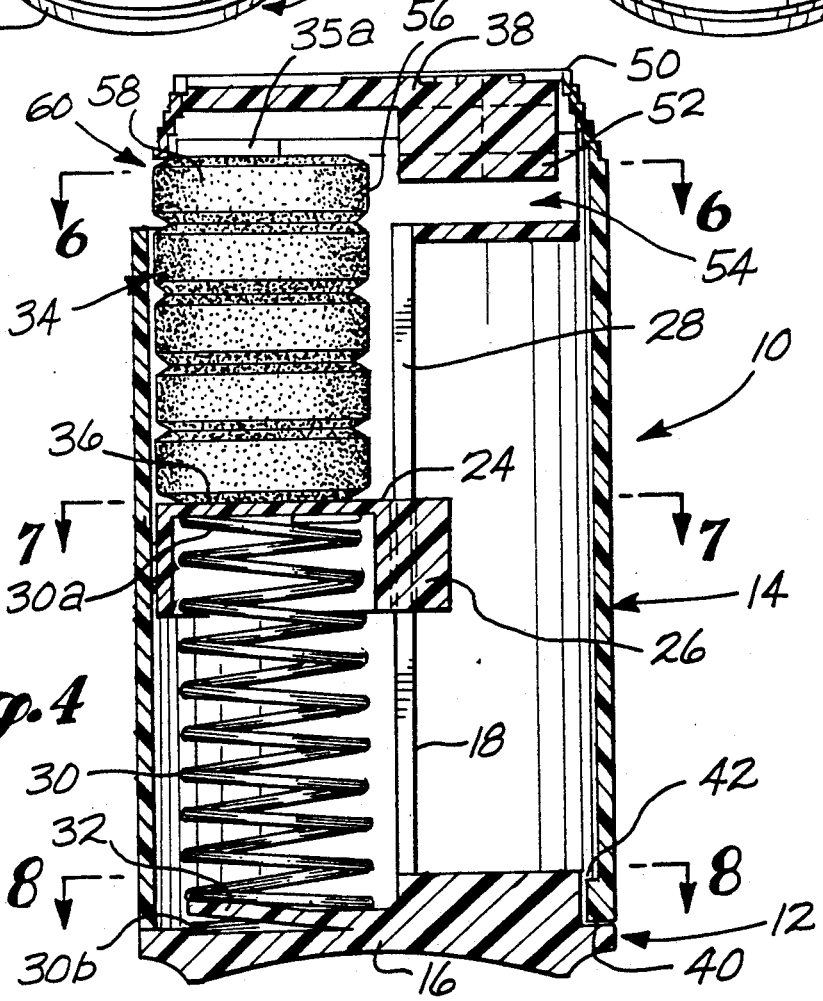
Fig. 4

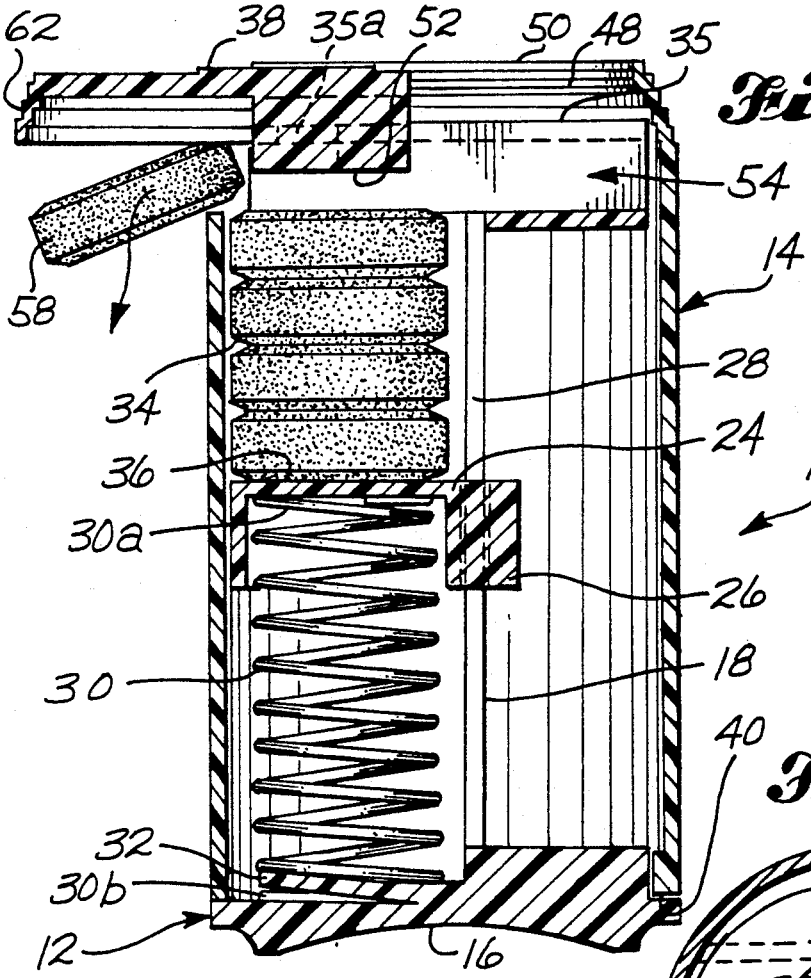
Fig. 5
Fig. 6
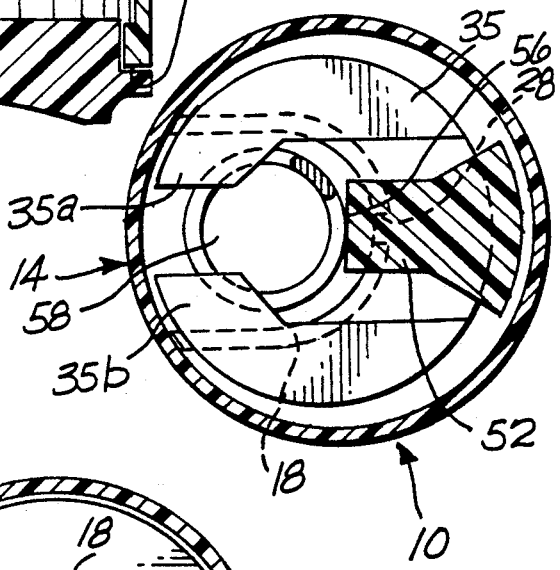
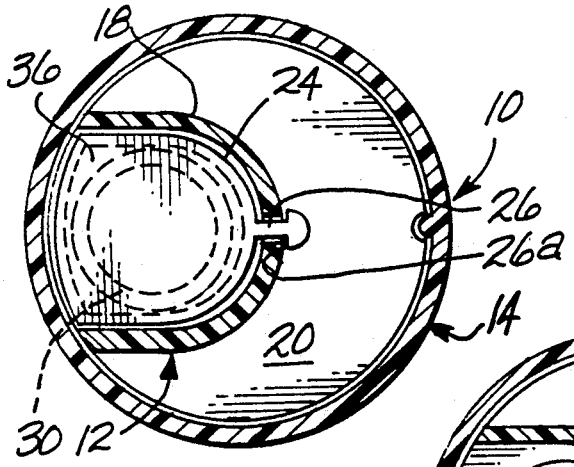
Fig. 7
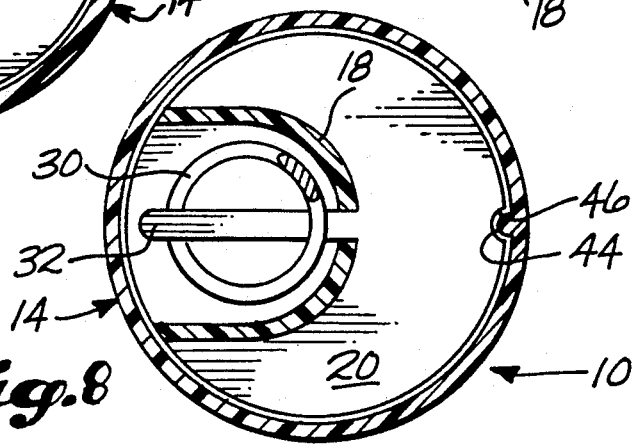
Fig. 8

CANDY DISPENSER

DESCRIPTION

1. Technical Field

The invention disclosed here generally relates to tablet dispensers, and more particularly, to hand-held candy dispensers that sequentially eject individual candy tablets from a stack of tablets.

2. Background of the Invention

Small, hand-held candy dispensers are well-known. Perhaps the best-known dispenser of this type is sold under the "PEZ" trademark. "PEZ" dispensers have been sold in the United States for years, and typically have a tablet magazine that holds a stack of candy tablets. The tablets are dispensed or ejected one-by-one by a pivoting cap at the top of the dispenser. The cap is usually shaped in the form of an animal head, or the head of a well-known cartoon character.

A dispenser of the above-described type is disclosed in U.S. Pat. No. 4,311,251, issued to Sternberg, on Jan. 19, 1982. Sternberg discloses a pivoting cover having a finger portion that pushes the topmost tablet of a stack outwardly from the top of the dispenser as the cover pivots. Similar dispensers are disclosed in U.S. Pat. Nos. 4,171,753; 3,942,683; 3,845,882; 3,844,445; 3,565,284; 3,410,455; 2,853,206; and French Patent No. 1.224.690. Although all of these patents disclose variations on hand-held tablet dispenser designs, all have the common feature of ejecting tablets via a pivoting action.

As will become apparent, a significant difference between the present invention and the dispensers disclosed in the above-mentioned patents is that the present invention does not dispense tablets via a pivoting action or pivoting cap. Instead, a finger-driven top portion of the dispenser housing linearly slides outwardly with respect to the rest of the housing, and thereby drives individual tablets from the dispenser. More specifically, as such portion moves, an underlying abutting surface carried thereby engages with the topmost tablet of the stack, and drives it out through a side opening in the dispenser casing. This is but one difference that sets the present invention apart from the various dispensers disclosed in the patent literature. Still other differences will become further apparent upon a review of the following description.

SUMMARY OF THE INVENTION

The invention is best summarized as a novelty candy dispenser that is shaped to emulate a beverage can, although it could emulate other types of cans as well. A tablet dispenser in accordance with the invention basically includes two parts: a tablet magazine having a circular base and a vertical portion that upstands from the base; and an outer, cylindrical casing that fits over the vertical portion and onto the base, thereby forming the shape of a can.

The vertical portion of the magazine is shaped so as to define a columnar space that stores or holds a stack of candy tablets. Received within such space is a tablet platform upon which the stack of tablets rests. A spring normally pushes such platform upwardly as the tablets are dispensed, one-by-one, through an opening or portal in the outer casing. The magazine also has a retainer portion that extends over the top of the columnar space, and thereby prevents tablets from exiting upwardly.

Instead, tablets are dispensed or pushed laterally outwardly by a sliding tablet ejector.

The tablet ejector makes up a sliding portion of the top of the outer casing, and preferably, such portion is shaped to have the appearance of the pop-top tab of a conventional beverage can. It slides, along tracks, both laterally outwardly and inwardly. It carries a downwardly-depending abutment that travels across the top of the columnar space of the magazine as it moves outwardly. When this happens, the abutment engages with the topmost tablet in the stack and drives it out through the portal opening in the casing.

BRIEF DESCRIPTION OF THE DRAWINGS

In the drawings, like reference numerals and letters refer to like parts throughout the various views, and wherein:

FIG. 2 is a pictorial view of the candy dispenser shown in FIG. 1, but after assembly;

FIG. 3 is a view like FIG. 2, but shows a candy tablet being ejected from the dispenser;

FIG. 4 is a side cross-sectional view of the dispenser shown in FIGS. 2 and 3, and shows a stack of candy tablets being held or stored within a magazine portion of the dispenser;

FIG. 5 is a cross-sectional view like FIG. 4, but illustrates how the topmost tablet of the stack is ejected from the dispenser;

FIG. 6 is a cross-sectional view taken along line 6—6 in FIG. 4;

FIG. 7 is another cross-sectional view taken along line 7—7 in FIG. 4; and FIG. 8 is still another cross-sectional view taken along line 8—8 in FIG. 4.

BEST MODE FOR CARRYING OUT THE INVENTION

Figure 1:
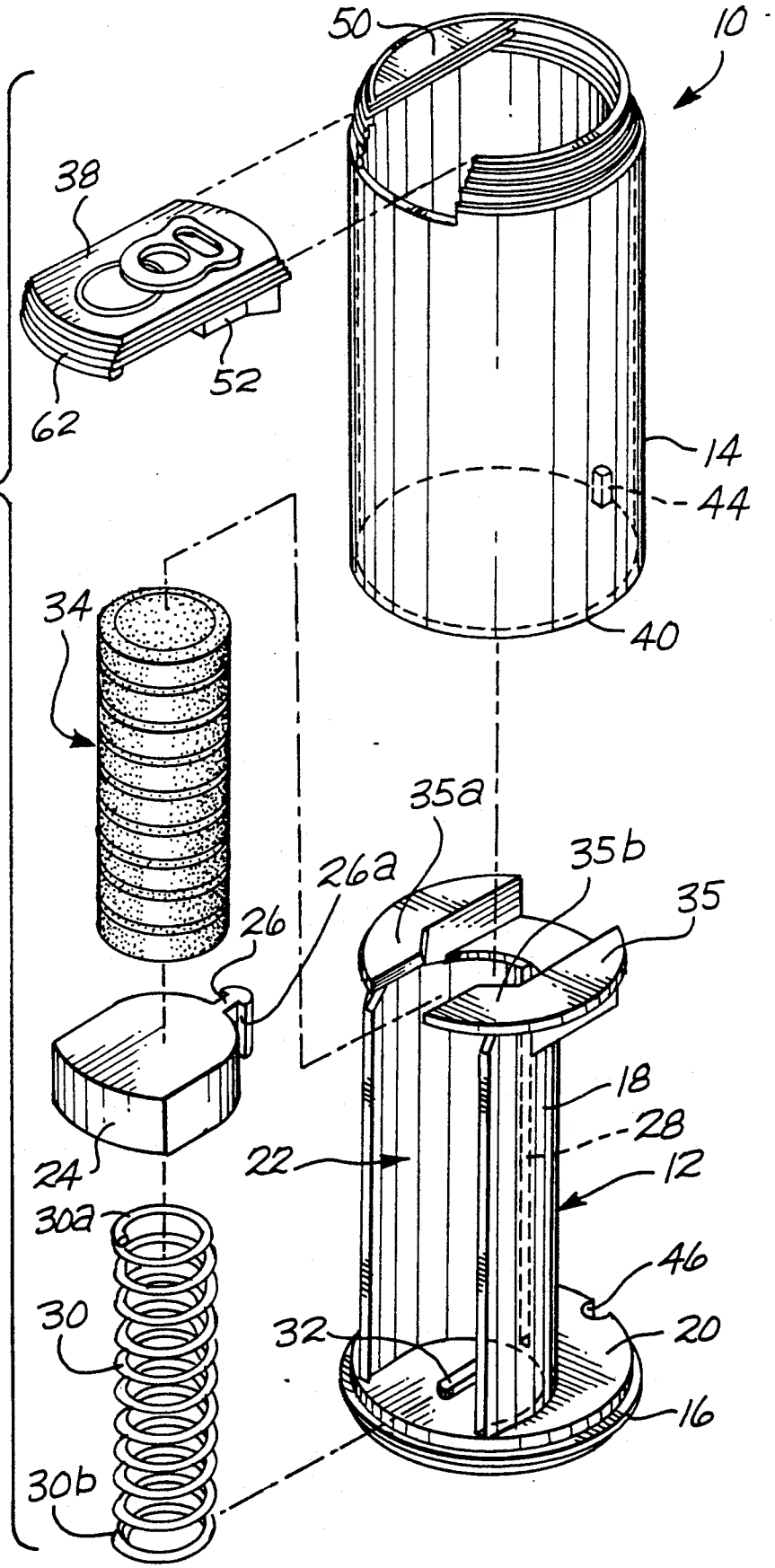
FIG. 1 is an exploded pictorial view of a candy dispenser in accordance with a preferred embodiment of the present invention.

Referring now to the drawings, and first to FIG. 1, shown generally at 10 is a candy dispenser in accordance with a preferred embodiment of the present invention. The candy dispenser is made up of two main components or portions. The first portion is a candy or tablet magazine, indicated generally at 12. The second portion is a hollow, cylindrical casing, which is indicated generally at 14.

The magazine portion 12 has a circular base 16, the bottom of which is shaped to have the same general appearance or shape as the bottom of a conventional, pop-top beverage can. Such cans are well-known throughout the United States and the world, and may be obtained in virtually any supermarket. As is well-known, they are invariably made of aluminum, and have a tab in their top surface which is pulled upwardly to create a lever action that pops open a weakened area in the top of the can.

The magazine 12 also has a vertical portion 18 that upstands from the top surface 20 of magazine base 16. Such portion 18 is generally trough-shaped and defines a columnar space, indicated generally by arrow 22, in which tablets are stored or held. A tablet platform 24 is slidable vertically upwardly or downwardly in columnar space 22.

The tablet platform 24 is retained in space 22 by a guide or tab portion 26, the latter extending through a vertical slot 28 in trough 18. The tab 26 is free to slide upwardly and downwardly along slot 28, the latter defining a trackway. However, the outer end of the tab 26 has outwardly-projecting flanges 26*a* which prevent it from being pulled out of the slot 28, thereby holding the tablet platform 24 in columnar space 22.

A conventional spring 30 is positioned between the lower side of the tablet platform 24 and the top surface 20 of magazine base 16. As is best seen in FIGS. 4 and 5, the tablet platform 24 is hollow underneath, opening downwardly, for the purpose of receiving and retaining the upper end 30*a* of the spring. The lower end 30*b* of the spring is retained in place by a small catch 32 that protrudes upwardly from the top surface 20 of magazine base 16.

The spring 30 is always in a certain amount of compression, and thus, is biased to push the tablet platform 24 upwardly. As is best seen in FIGS. 4 and 5, a stack of tablets, indicated generally at 34, normally rests upon the top surface 36 of the platform 24. Thus, the spring 30 normally pushes the tablets 34 upwardly through columnar space 22 as the tablets are dispensed.

The magazine 12 has a retainer portion 35 at the top of trough 18. The retainer portion 35 prevents individual tablets 34 from exiting upwardly out of columnar space 22. The retainer portion 35 has opposing, spaced-apart flanges 35*a*, 35*b*, which project at least partially across the top of columnar space 22. These flanges 35*a*, 35*b* also define a pathway for an abutment portion of a tablet ejector 38 which is carried by the outer casing 14. This is further described below.

The dispenser 10 is assembled by placing the outer casing 14 over magazine portion 16, until the casing's open, bottom end 40 mates with the base 16 of the magazine 12. Referring briefly to FIGS. 4 and 5, an upwardly projecting portion 42 of the base 16 is plug-fit into the bottom end opening 40 of the casing 14. The casing 14 has a key 44 which fits into a complementing keyway 46 in the magazine base 16. This ensures that the tablet ejector 38 will be properly aligned relative to columnar space 22 and the tablets 34 held therein.

Like the magazine base 16, the outer casing 14 is shaped to simulate the appearance of the side and top of a conventional pop-top beverage can as described above. The top surface of the ejector portion 38 is further shaped to simulate the appearance of the pop-top region of such a can.

Referring now to FIGS. 2 and 4, the ejector 38 makes up a portion of the casing's top surface 50, and slides laterally along top surface grooves 48. The ejector 38 has an underlying abutment portion 52 which depends downwardly therefrom, and is normally positioned in a space 54 in the retainer portion 35 of the magazine 12 when the ejector is in the closed or laterally inwardmost position. When the ejector 38 is slid linearly or laterally outwardly with respect to the remainder of the casing's top surface 50, that is, to the position shown in FIGS. 3 and 5, the abutment 52 catches or engages with the edge surface 56 on one side of the topmost tablet 58. The abutment 52 then moves between the spaced-apart flanges 35*a*, 35*b* of magazine retainer portion 35, which pushes or pulls, or otherwise drives, the tablet 58 laterally outwardly through a tablet-dispensing opening or portal 60 in the upper side of casing 14.

The tablet-dispensing portal 60 is positioned level with the normal position of the topmost tablet 58. In other words, it is located in the upper side of the outer casing 14 near the casing's top surface 50. When the ejector 38 is in the closed position shown in FIG. 2, it has a downwardly-depending peripheral lip 62 which at least partially closes the tablet-dispensing portal 60, thereby preventing tablets from falling out of the dispenser 10. When the ejector moves outwardly, as shown at FIG. 5, the lip 62 may also function to at least partially hold the topmost tablet 58 such that it does not automatically drop from the dispenser. Instead, in order to be removed, the tablet 58 must be pulled downwardly by the user's fingers Retracting the ejector 38, or otherwise moving it laterally inward to the position shown in FIGS. 3 and 5, enables the magazine spring 30 to push the stack of tablets 34 upwardly so that the new or next topmost tablet is ready to be ejected. In this manner, each tablet in the stack may be dispensed one-by-one.

Having thus described a preferred embodiment for carrying out the invention, it is to be understood that the preceding description is not to be taken in the limiting sense. It is conceivable that certain changes could be made to the invention as described above without departing from what is intended to be the spirit and scope of the invention. Therefore, the invention is to be defined and limited only by the subjoined patent claim or claims, the interpretation of which is to be made in accordance with the well-established doctrines of patent claim interpretation.

What is claimed is:

1. A tablet dispenser, comprising:

a tablet magazine having a circular base and a generally vertical portion extending upwardly from said base, said vertical portion defining a columnar space for storing a stack of tablets to be dispensed, and a tablet platform slidably movable upwardly and downwardly within said columnar space, wherein said stack of tablets normally rests upon said platform, and a magazine spring connected to said platform and biased to normally push said platform and tablets upwardly, said tablet magazine further having a retainer portion adjacent the upper end of said vertical portion, for preventing the topmost tablet of said stack from being pushed by said spring upwardly out of said columnar space; and a hollow, outer casing, said casing having a top end and an open bottom end, said casing being releasably connectable to said magazine base, and covering said vertical and retainer portions of said magazine when said casing is connected to said base, said casing having a tablet-dispensing portal positioned adjacent the normal position of said topmost tablet in said stack, and further, said top end of said casing having a tablet ejector portion, said tablet ejector portion being laterally movable outwardly and inwardly along a linear path relative to the remainder of said top end, said ejector portion having a downwardly-depending abutment positioned and shaped to capture an edge of said topmost tablet within said columnar space as said tablet ejector portion moves outwardly, for driving said topmost tablet through said tablet-dispensing portal of said casing.

2. The tablet dispenser of claim 1, wherein said vertical portion of said tablet magazine has a generally trough-like shape and includes a vertically-extending trackway, said tablet platform having a guide portion in sliding engagement with said trackway, for guiding said platform upwardly and downwardly, and for retaining said platform within said columnar space.

3. The tablet dispenser of claim 1, wherein said retainer portion of said tablet magazine includes opposing, spaced-apart flange portions extending over the top of said columnar space, and wherein said downwardly depending abutment of said tablet ejector portion passes between said flange portions when said tablet ejector portion moves to its outwardmost position.

4. The tablet dispenser of claim 1, wherein said tablet ejector portion has a downwardly-depending outer lip, for at least partially closing said casing portal when said ejector portion is moved to its inwardmost position.

5. A tablet dispenser, comprising:

a tablet magazine having a base portion shaped to have substantially the same appearance as the bottom of an aluminum pop-top beverage can, said tablet magazine having a vertical portion that upstands from said base portion and defines a columnar space for holding a stack of tablets to be dispensed, and a hollow, outer casing having an open lower end, said casing being shaped to have substantially the same appearance as the side and top of said beverage can, and including a pop-top portion in the top of said casing that simulates the appearance of the pop-top tab of said beverage can, said casing internally receiving said vertical portion of said magazine, in a manner so that the topmost tablet of said stack of tablets is normally positioned adjacent said pop-top portion of said casing, with said casing further including tablet-dispensing portal means, adjacent said topmost tablet, and through which tablets are dispensed from said tablet magazine one by one, said casing being releasably connectable to said base portion of said magazine in a manner so as to form the appearance of said beverage can in its entirety, said pop-top portion of said casing being laterally slidable, and having an abutment that engages with the topmost tablet of said stack each time said pop-top portion slides outwardly, to dispense said tablet through said tablet-dispensing portal means.

6. The tablet dispenser of claim 5, wherein said base portion of said tablet magazine has a portion that is shaped to be plug-fit into said lower end of said outer casing.

7. The tablet dispenser of claim 6, including a key member mounted to the inner sidewall of said casing adjacent said open lower end of said casing, and a keyway in said tablet magazine base portion, said keyway being shaped to receive said key member for aligning said casing relative to said tablet magazine when said casing is connected to said tablet magazine.

8. The tablet dispenser of claim 5, wherein said laterally-slidable pop-top portion of said casing includes a peripheral lip that is shaped to at least partially close said tablet-dispensing portal means when said pop-top portion is laterally slid to its inwardmost position.

* * * * *